US011647323B2

(12) United States Patent
Dyreby et al.

(10) Patent No.: US 11,647,323 B2
(45) Date of Patent: May 9, 2023

(54) LOUDSPEAKER

(71) Applicant: Bang & Olufsen A/S, Struer (DK)

(72) Inventors: Jakob Dyreby, Struer (DK); Jens Rahbek, Struer (DK)

(73) Assignee: BANG & OLUFSEN A/S, Struer (DK)

( * ) Notice: Subject to any disclaimer, the term of this patent is extended or adjusted under 35 U.S.C. 154(b) by 0 days.

(21) Appl. No.: 17/713,351

(22) Filed: Apr. 5, 2022

(65) Prior Publication Data

US 2022/0329932 A1 Oct. 13, 2022

(30) Foreign Application Priority Data

Apr. 13, 2021 (DK) ..... PA 2021 00369
Aug. 16, 2021 (EP) ..... 21191514

(51) Int. Cl.

| | |
|---|---|
| ***H04R 1/26*** | (2006.01) |
| ***H04R 1/02*** | (2006.01) |
| ***H04R 1/28*** | (2006.01) |
| ***H04R 1/34*** | (2006.01) |

(52) U.S. Cl.

CPC ..... *H04R 1/26* (2013.01); *H04R 1/025* (2013.01); *H04R 1/288* (2013.01); *H04R 1/2896* (2013.01); *H04R 1/345* (2013.01)

(58) Field of Classification Search

CPC ..... H04R 1/26; H04R 1/025; H04R 1/288; H04R 1/2896; H04R 1/345

See application file for complete search history.

(56) References Cited

U.S. PATENT DOCUMENTS 5,525,767 A * 6/1996 Fields ..... H04R 1/342 181/146
6,356,642 B1 * 3/2002 Nakamura ..... H04R 1/345 381/342
9,503,806 B2 * 11/2016 Crosswell ..... H04R 1/2834

(Continued)

OTHER PUBLICATIONS

European Search Opinion for European Patent App. No. 21191514.5 (dated Feb. 10, 2022).

*Primary Examiner* — Oyesola C Ojo
(74) *Attorney, Agent, or Firm* — Schmeiser, Olsen & Watts, LLP

(57) ABSTRACT

The present invention describes a loudspeaker comprising a housing and a plurality of sound transducers arranged inside said housing, where the housing has two sides arranged on either side of a x-y plane with a mutual distance between said sides measured along a z-axis orthogonal to the x-y plane, and a front facing side and a rear facing side, and a top and a bottom, wherein a. A first sound transducer is arranged inside a first cavity inside said loudspeaker housing, where said first cavity has a narrow first slit in the y-direction provided in the rear facing side, where said first slit has a width z1 in the z-direction, and a length y1 in the y-direction where the length y1 in the y-direction is larger than the width z1 in the z-direction;

b. A second sound transducer is arranged inside a second cavity inside said loudspeaker housing, separate from said first cavity, and where said second cavity is provided with a narrow second slit in the y-direction provided in the front facing side, where said second slit has a width z2 in the z-direction, and a length y2 in the y-direction, where the length y2 in the y-direction is larger than the width z2 in the z-direction.

10 Claims, 6 Drawing Sheets

(56) References Cited

U.S. PATENT DOCUMENTS

| | | | | |
|---|---|---|---|---|
| 10,356,499 | B2 * | 7/2019 | Eom | H04R 1/023 |
| 11,012,767 | B2 * | 5/2021 | Kim | H01Q 1/42 |
| 11,026,017 | B2 * | 6/2021 | Mäkivirta | H04R 1/24 |
| 11,128,947 | B2 * | 9/2021 | Darling | H04R 1/021 |
| 2003/0228027 | A1 * | 12/2003 | Czerwinski | H04R 7/20 381/386 |
| 2004/0125974 | A1 * | 7/2004 | Kosatos | H04R 1/323 381/335 |
| 2004/0252856 | A1 * | 12/2004 | Masuda | H04R 1/2842 381/345 |
| 2014/0044300 | A1 * | 2/2014 | Osada | H04R 1/02 381/387 |
| 2014/0219491 | A1 * | 8/2014 | Ludlum | H04R 1/02 381/387 |
| 2015/0053497 | A1 * | 2/2015 | Horiuchi | H04R 1/345 181/199 |
| 2015/0086057 | A1 * | 3/2015 | Christner | H04R 1/2819 381/349 |
| 2015/0195635 | A1 * | 7/2015 | Garfio | H04R 31/006 381/386 |
| 2018/0220212 | A1 * | 8/2018 | Lupfer | H04R 5/02 |
| 2020/0090662 | A1 * | 3/2020 | Castro | H04R 1/345 |
| 2020/0260178 | A1 * | 8/2020 | Sakaguchi | H04R 1/2842 |
| 2021/0092510 | A1 * | 3/2021 | Darling | H04R 1/22 |

* cited by examiner

LOUDSPEAKER

This application claims the benefit of Danish Application No. PA 2021 00369 filed Apr. 13, 2021 and EP 21191514.5 filed Aug. 16, 2021, which are hereby incorporated by reference in their entirety as if fully set forth herein.

FIELD OF THE INVENTION

The present invention relates to a loudspeaker where the arrangement of the sound transducers inside a loudspeaker housing and particularly the sound emitting openings in the loudspeaker housing together with the arrangement of the sound transducers allows for an unconventional and novel construction of the loudspeaker as such.

BACKGROUND OF THE INVENTION

In the art, it is well known to arrange sound transducers inside a loudspeaker housing where the sound transducers, depending on the frequency range in which they emit sound, may emit in different directions. For example, low frequency sound transducers (woofers) may be directed towards the floor whereas midrange sound transducers and high range sound transducers (tweeters) may be directed towards the listener's position such that all audible frequencies are represented. The arrangement of the sound transducers and the direction in which they emit sound has influence on the propagation of sound waves at different frequencies. The small wavelength compared to the sound transducer size at high frequencies implies that high frequency sound transducers should be directed towards the listener in order for a listener to enjoy the full spectrum emitted by for example tweeter and a mid-range sound transducer whereas for low frequencies the sound tends to spread more widely and as such the direction in which the sound is emitted is not that important.

The outer dimensions of a typical loudspeaker are determined by the size of the sound transducers in that it is common practice to arrange the sound transducers such that they emit sound perpendicular to typically the front facing side of a loudspeaker housing and/or to arrange the woofer or subwoofer such that they emit sound towards the floor and as such the front facing side and the bottom of the loudspeaker housing have areas corresponding to at least the areas of the fronts of the corresponding sound transducers. This of course leads to the fact that powerful loudspeaker units will have a certain size in order to accommodate the sound transducer units mounted in this way and as such may be rather bulky.

OBJECT OF THE INVENTION

Often there is a desire to have a better compromise between good and powerful sound combined with a more compact size of the loudspeaker housing. This has hitherto not been possible with the traditional loudspeaker installations without sacrificing sound quality, but this is where the present invention provides a solution.

DESCRIPTION OF THE INVENTION

The present invention as set out in independent claim 1 provides a loudspeaker comprising a housing and a plurality of sound transducers arranged inside said housing, where the housing has two sides arranged on either side of a x-y plane with a mutual distance between said sides measured along a z-axis orthogonal to the x-y plane, and a front facing side and a rear facing side, and a top and a bottom, wherein a. A first sound transducer is arranged inside a first cavity inside said loudspeaker housing, where said first cavity has a narrow first slit in the y-direction provided in the rear facing side, where said first slit has a width z1 in the z-direction, and a length y1 in the y-direction where the length y1 in the y-direction is larger than the width z1 in the z-direction;

b. A second sound transducer is arranged inside a second cavity inside said loudspeaker housing, separate from said first cavity, and where said second cavity is provided with a narrow second slit in the y-direction provided in the front facing side, where said second slit has a width z2 in the z-direction, and a length y2 in the y-direction, where the length y2 in the y-direction is larger than the width z2 in the z-direction.

By arranging the first and second sound transducers in separate cavities where each cavity is provided with a slit, the sound from one cavity is substantially isolated from the sound from the other cavity and at the same time the slits will act as means to direct the sound in a definite direction. As the slits are relatively narrow width-wise compared to their height, a relatively slim design of the loudspeaker may be achieved. The cavities only have access to the ambient surroundings through the slits whereby the sound generated in each cavity by the sound transducer is only emitted through the slit.

In a further embodiment of the invention with respect to the first slit the width z1 is between 10-60% of the largest dimension of the membrane of the first sound transducer and the length y1 is between 50-300% of the largest dimension of the membrane of the first sound transducer.

Acoustically the slit must be dimensioned relative to the dimensions of the active area of the sound transducer, typically the diameter of the sound transducer's membrane or, in case of a non-circular membrane, the largest dimension of the sound transducer's membrane. The membrane will be agitated when active and thereby move air. In order for this air to move in and out of the cavity in a manner where the sound is not distorted by the acoustic air velocity, the slit needs to have a certain area. Consequently, by relating the size and dimensioning of the slit relative to the size of the sound transducers' membrane the relationship between acoustic air velocity and minimized distortion is achieved.

This is also an aspect in a further advantageous embodiment where with respect to the second slit the width z2 is between 10-60% of the largest dimension of the membrane of the second sound transducer, and the length y2 is between 50-300% of the largest dimension of the membrane of the second sound transducer.

In a further inventive embodiment of the invention, a third sound transducer is arranged in the front facing side, where said third sound transducer is arranged in a separate third cavity or in an acoustic volume created behind the membrane of the first sound transducer.

Often tweeters are self-contained units and as such are provided with their separate acoustic volume behind their membrane, which when arranged in a loudspeaker construction will not interfere with other sound transducers. However, it may also be advantageous to install a "bare" tweeter, providing the possibility to design the cavity and the acoustic volume, and thereby influence the acoustic characteristics of the high range of the sound reproduction. In this case it will be necessary to create/provide a cavity or at least an acoustic volume behind the tweeter which is separated from the acoustic volumes or cavities of other sound transducers in the construction.

In a still further advantageous embodiment of the invention, the first sound transducer is tilted such that it mainly emits sound along an axis W, where said axis W is at an angle of between 45° and 90° relative to the x-y plane and where said axis W is substantially parallel to the x-z plane.

By tilting the first sound transducer relative to the surface of the housing from which it normally emits sound (in this example the rear side), it is possible to create a slimmer/narrower housing without sacrificing the size of the sound transducers. Usually, the size of the loudspeaker provides for a more powerful sound and at the same time a richer sound. Consequently, by tilting the sound transducers relative to the side of the housing from which the sound is emitted it is possible to slim the housing and due to the provision of a cavity, a pure sound picture which is emitted by the slits is still maintained.

In a further advantageous embodiment, the second sound transducer is tilted such that it mainly emits sound along an axis K, where said axis K is at an angle of between 45° and 90° relative to the x-y plane and where said axis K is substantially parallel to the x-z plane.

It is also foreseen that the W axis or K-axis may be tilted slightly out of planes parallel to the x-z plane, in order to optimise the arrangement of the sound transducers inside the loudspeaker housing or to minimize the overall footprint of the loudspeaker.

In a further advantageous embodiment, the first sound transducer is tilted such that the cavity between the first sound transducer's membrane and the housing side covering the front of the first sound transducer is wedge-shaped with the thick end of the wedge-shaped cavity adjacent to the slit.

In this manner the cavity may be designed such that the opening in the rear facing side is large enough to reduce the air velocity through the slit while maximising the acoustic volume behind the first sound transducer. The air flow is greatest near the slit as all air must pass through this area. By having the largest cavity cross-section near the slit, the air velocity (which equals air flow divided by the area of the cross section of the opening) is kept to an acceptable level, thus avoiding air turbulence with sound distortion as a result.

Unwanted sound distortion in the first transducer cavity or slit caused by air turbulence can be further avoided by limiting the air velocity using a compressor algorithm in the signal chain of the first sound transducer, for example implemented in digital signal processing means.

In a further advantageous embodiment, the second sound transducer is tilted such that any resonance occurring in the second cavity is moved to a frequency as high as possible while leaving space for an optional absorbent material for damping the resonance. The tilt angle is also chosen such that turbulence noises due to high air velocity are avoided.

Naturally, the first sound transducer arranged in the first cavity may be a woofer having a larger diameter such that by tilting the large sound transducer unit a substantial saving in loudspeaker housing width may be obtained. However, by further tilting the midrange sound transducer it also provides the possibility to design the housing more freely (and even slimmer).

Consequently, in a further advantageous embodiment of the invention, the distance between the sides in the z-direction is between 30% and 150% of the largest dimension of the membrane of the first sound transducer, and the distance between the top and bottom is between 150% and 500% of the largest dimension of the membrane of the first sound transducer and the distance between the front facing side and the rear facing side is between 100% and 350% of the largest dimension of the membrane of the first sound transducer. With the arrangement for example of tilting the sound transducer units as suggested above it is possible to design a loudspeaker not having a quadratic or rectangular footprint but may have a cross section with non-parallel sides such that the, for example, front facing side of the housing is narrower than the rear facing side. In this manner it is possible to accommodate the sound transducer units especially when the sound transducer units are tilted as suggested on one of the advantageous embodiments above.

In a still further advantageous embodiment of the invention, the front facing side and/or the rear facing side are curved or semi-circular (when projected onto the x-z plane. Naturally, the sound transducers used in a loudspeaker arrangement according to the present invention may be selected such that a very broad frequency range is achieved such as suggested between 40 and 25,000 Hz. The overall frequency response of the loudspeaker may be equalized using digital signal processing means in the signal chain of the loudspeaker and the individual sound transducers.

DESCRIPTION OF THE DRAWING

The invention will now be explained with reference to the accompanying drawing where.

DETAILED DESCRIPTION OF THE INVENTION

Figure 1:
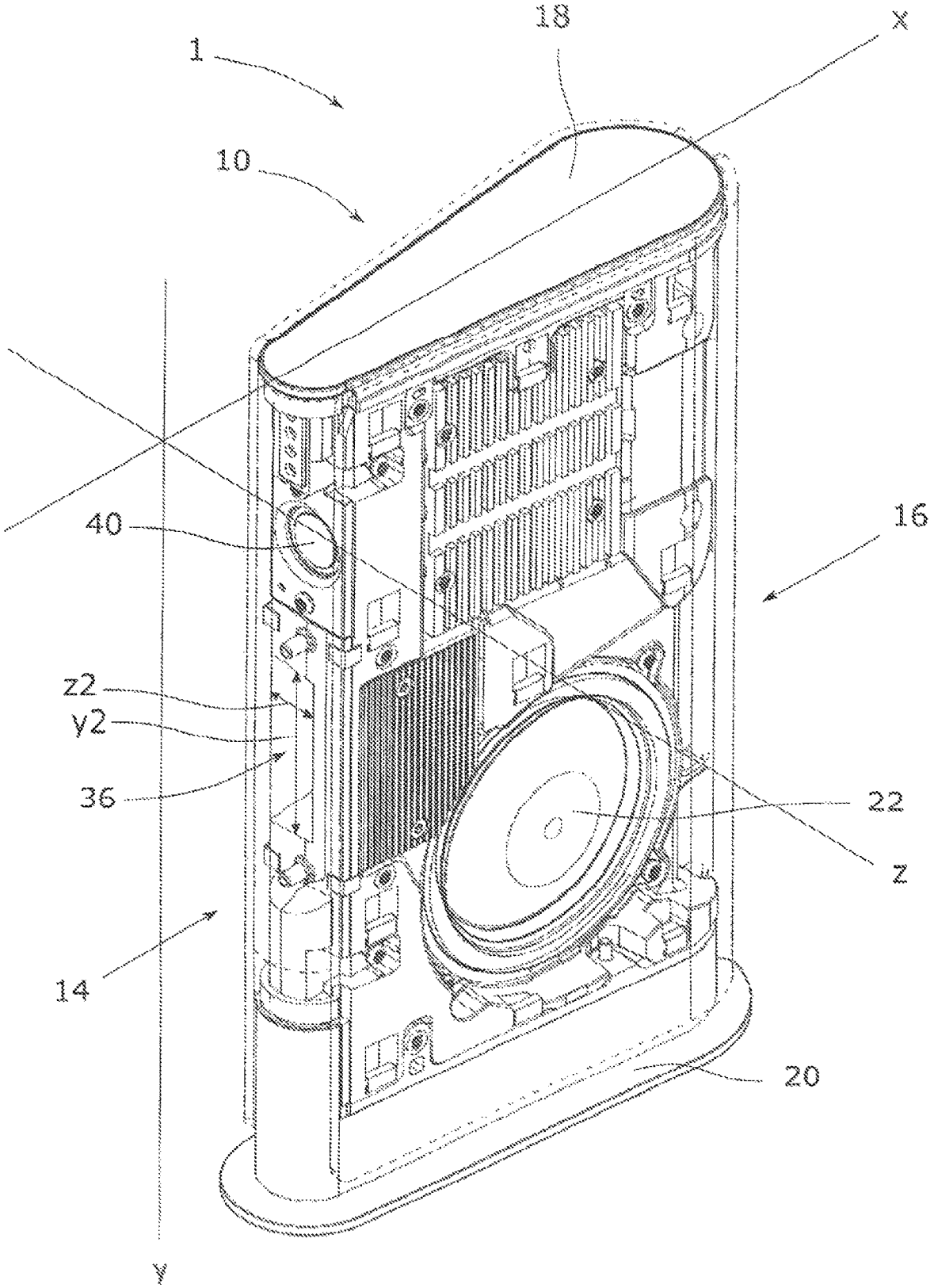
FIGS. 1 and 2 illustrate an embodiment of the invention where the housing sides have been removed from the unit in order to illustrate the construction of the loudspeaker.

In FIG. 1 is illustrated an embodiment of the invention where the housing sides have been removed from the unit in order to illustrate the construction of the loudspeaker. The loudspeaker 1 has a housing 10, which has been partly removed in this illustration, but see also FIGS. 3-6. The housing 10 has two sides 11,12. The sides 11,12 are arranged on either side of an x-y plane as defined by the x- and y-axes in FIG. 1. Orthogonal to the x-y plane is indicated a z-axis such that the sides 11,12 of the housing 10 are arranged at a mutual distance on either side of the x-y plane where the distance is measured along the z-axis. Furthermore, the loudspeaker 1 has a front facing side 14 and a rear facing side 16. Furthermore, a top 18 and a bottom 20 is provided.

Figure 2:
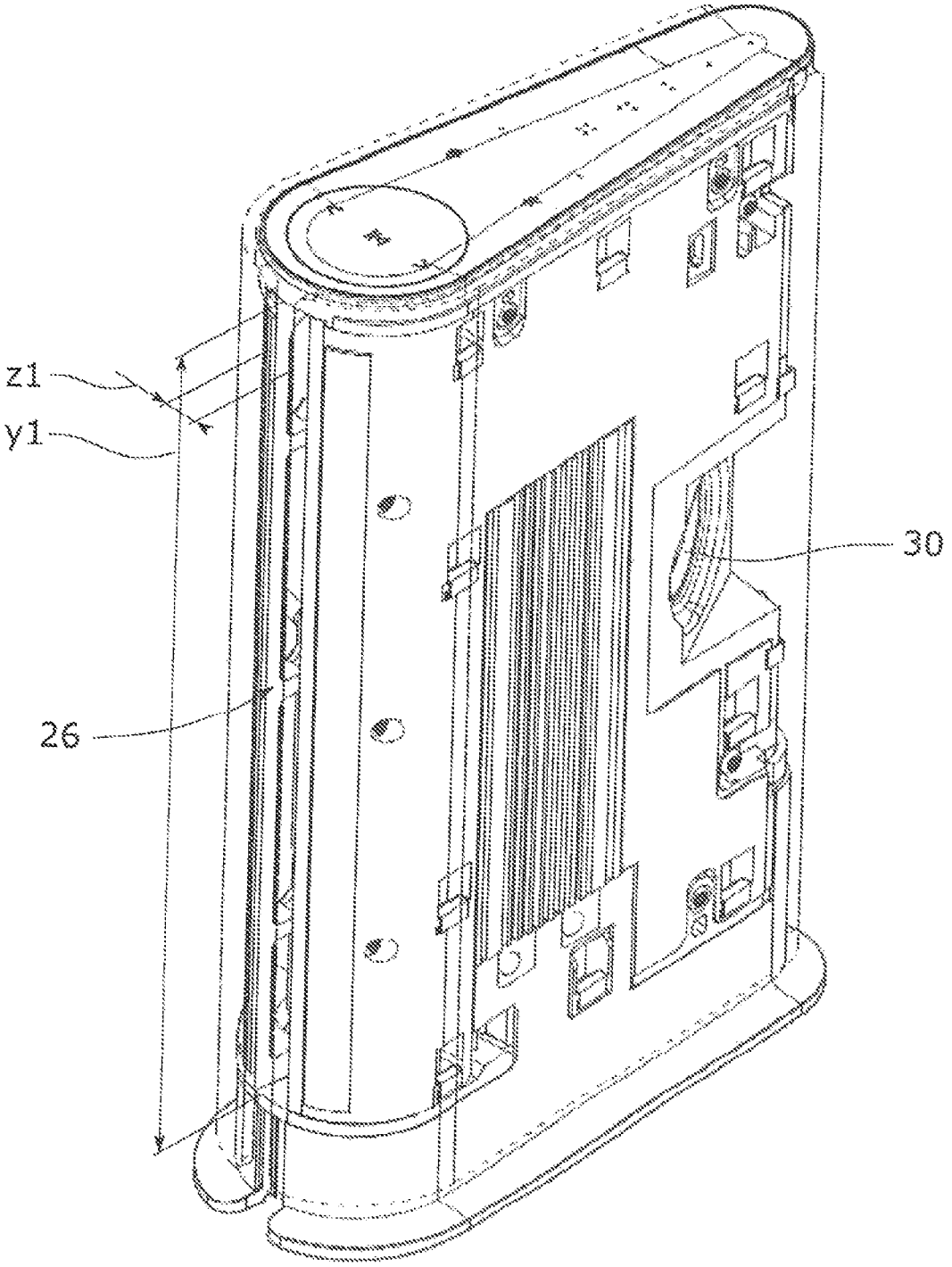
Figure 3:
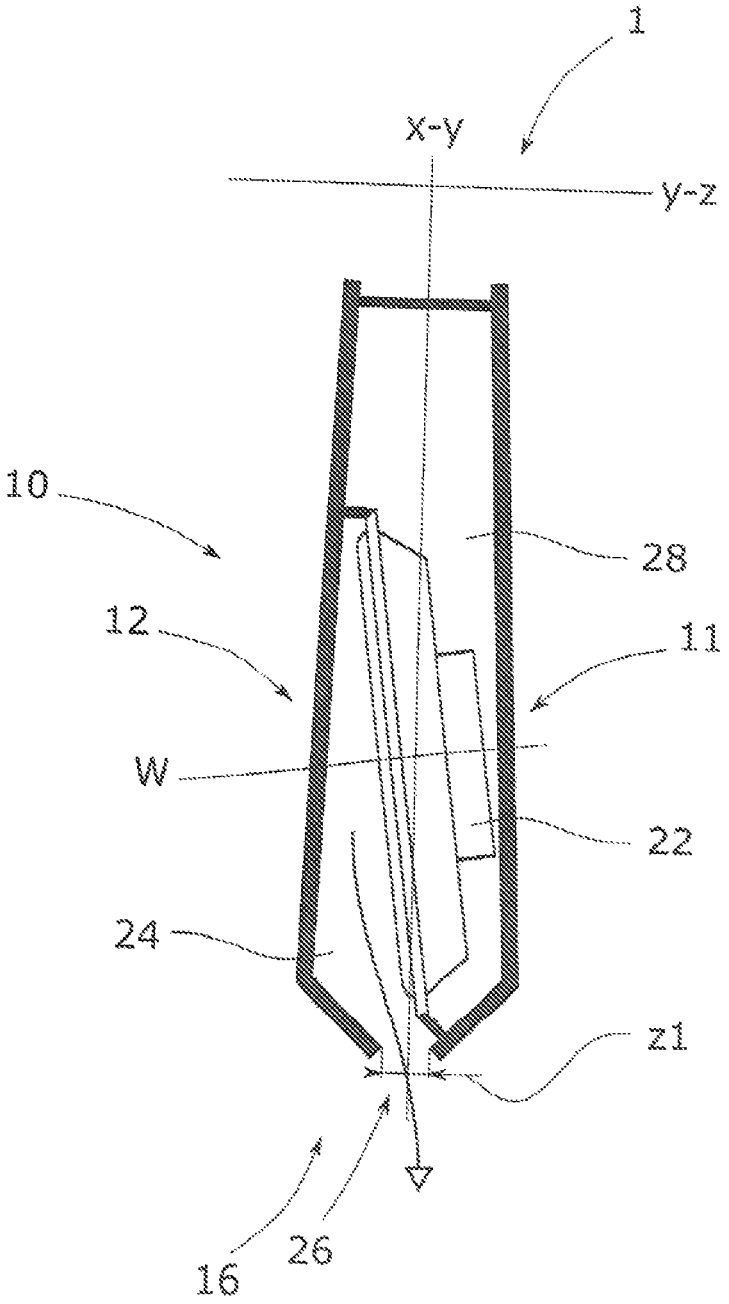
FIGS. 3, 4 and 5 illustrate schematic cross-sections of possible embodiments.

A first sound transducer 22 is arranged in a separate first cavity 24 (see FIGS. 1 and 3). This sound transducer 22 is provided with an acoustic volume 28 behind the sound transducer 22. The acoustic volume 28 is arranged on the rear side of the loudspeaker membrane, i.e. the opposite side to where it is intended that sound is emitted. The acoustic volume 28 extending throughout a large part of the volume of the loudspeaker housing 10 to maximise the acoustic performance of the sound transducer 22. The sound transducer 22 is tilted from a traditional position in the rear facing side 16 mainly emitting sound along the x-axis to a position where it will mainly emit sound along an axis W, where said axis W is at an angle of between 45° and 90° relative to the x-y plane and where said axis W is substantially parallel to the x-z plane. Said first cavity 24 is provided with a narrow first slit 26 (see FIGS. 2 and 3). The slit 26 is provided in the rear facing side 16 of the housing 10 and in this embodiment spans almost the entire height of the loudspeaker 1 in the y direction. The slit 26 allows the sound from the first sound transducer 22 to move in and out of the cavity 24 through the slit 26 in the rear facing side 16 in a direction substantially parallel to the x-y plane, despite the tilting of the sound transducer 22.

Figure 4:
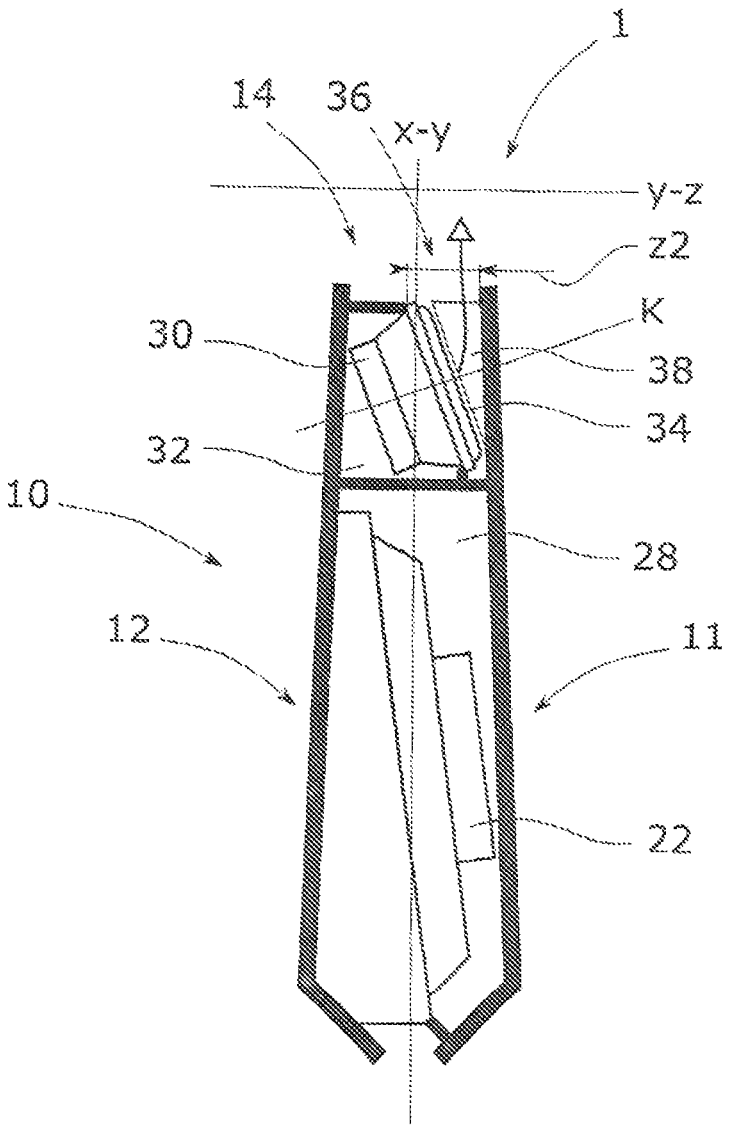

A second sound transducer 30 is arranged in a separate second cavity 34 (see FIGS. 2 and 4). This sound transducer 30 is provided with a separate acoustic volume 32 behind the sound transducer 30. This sound transducer 30 is, as is the case with the first sound transducer 22 discussed above, also tilted with respect to the x-y plane such that it will mainly emit sound along an axis K where said axis K is at an angle of between 45° and 90° relative to the x-y plane and where said axis K is substantially parallel to the x-z plane. As the sound transducer 30 is arranged in a separate cavity 34 provided with a slit 36, the sound will move in and out of the cavity 34 through the slit 36 in the front facing side 14 in a direction substantially parallel to the x-y plane due to the slit 36 provided in the cavity 34 and despite the tilting of the sound transducer 30.

Furthermore, the cavity 34 is optionally provided with acoustic damping material 38 occupying at least part of the cavity 34. The acoustic damping material preventing unwanted acoustical resonances and distortion.

Figure 5:
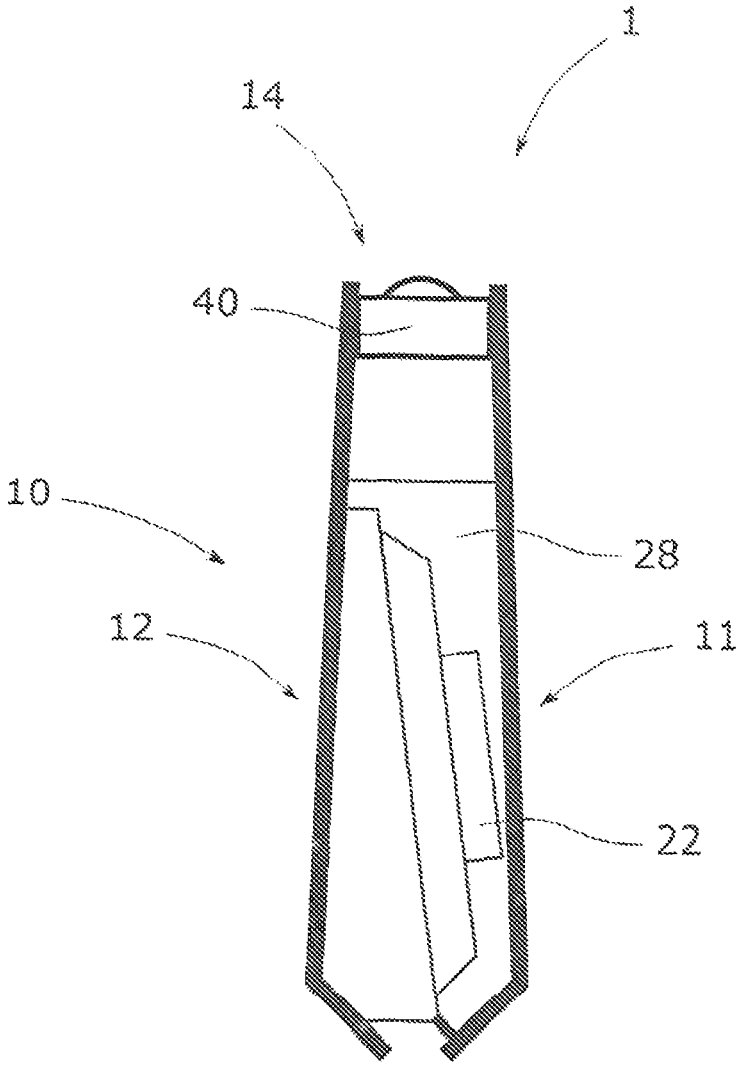

In FIGS. 3, 4 and 5 are illustrated schematic cross-sections through a loudspeaker embodiment according to the invention. In FIG. 5 the cross-section depicts a cross-section in an upper part of the loudspeaker 1, where a tweeter 40 is arranged on a front face 14, and in contact with the acoustic volume 28 behind the first sound transducer 22. This is possible as the tweeter 40 is closed with its own integrated acoustic volume. The cross-section in FIG. 4 is taken where the midrange sound transducer 30 is present in its separate cavity 34, such that the sound emitted by the midrange sound transducer 30 will be emitted through the slit 36 towards the listener's position. As the woofer and midrange sound transducers 22,30 may have overlapping frequency ranges the separation of the two types of speakers in separate cavities 24,34 guards against damaging interference between the sound transducers which may create distortion to the emitted sound.

A further aspect illustrated in the cross-sections in FIGS. 3 and 4 is the possibility to have a non-rectangular cross section of a loudspeaker. The inventive concept of tilting or angling the sound transducers makes it possible to depart from normal loudspeaker designs (square boxes) and in this manner reduce the footprint or base area a loudspeaker occupies, and still retain a sound force and quality previously reserved for loudspeakers with larger dimensions. This is achieved by angling the sound transducers relative to the x-y plane as discussed above. This provides design possibilities which have hitherto not been available, and as reflected in the designs illustrated in FIGS. 1 and 2. In the particular embodiments illustrated it is foreseen that the loudspeaker unit 1 may be a stand-alone unit, including the necessary electronic circuitry, energy storage, and communication means in order to emit sound from a remote source. Naturally, the loudspeaker may also be a more conventional speaker, being hard wired to a power source also supplying signals to the loudspeaker.

In the figures are illustrated wedge-shaped designs, but the provision of angling the speakers relative to the x-y plane provides freedom to almost create any shape of the loudspeaker unit.

As already discussed above the high frequency sound transducers must be arranged such that the sound emission is substantially directed towards a listener's position and therefore in embodiments of the invention where a third sound transducer 40 for example being a tweeter is arranged, this tweeter may be arranged as illustrated in FIG. 5 where the sound transducer 40 emits sound substantially directly towards a listening position along the x-axis. Typically, tweeters will have a smaller dimension and as such it is possible to arrange the tweeter between the housing sides 11,12 such that the tweeter faces towards to listening position (corresponding to the x-axis).

Figure 6:
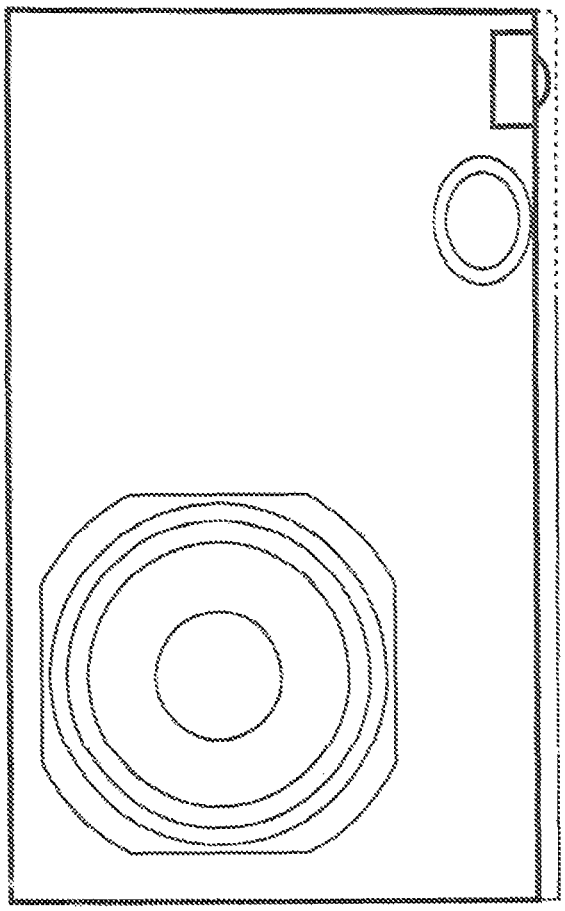
FIG. 6 illustrates a schematic side view of a loudspeaker.

In the side view of a loudspeaker according to the present invention as illustrated in FIG. 6, it may be seen that the woofer 22 is substantially arranged for emitting sound almost perpendicular to the x-y plane whereas the midrange sound transducer 30 being tilted the other way as evident from FIG. 4 emits sound in a less perpendicular direction than the woofer 22 and finally that the tweeter 40 emits sound directly in the x direction. The cavities 24,34 as well as the slits 26,36 facilitate that the sound from the sound transducers 22, 30 are directed in determined directions and as such the sound impression from the sound emitted from a loudspeaker as illustrated with reference to the figures is perceived as if the sound transducer units had been arranged in a more traditional manner. By arranging the sound transducer units as described above it becomes possible to achieve the slim design as illustrated in the cross sections in FIGS. 3, 4 and 5 and at the same time maintain a high-quality sound.

The invention claimed is:

1. Loudspeaker (1) comprising a housing (10) and a plurality of sound transducers (22,30,40) arranged inside said housing (10), where the housing (10) has two sides (11,12) arranged on either side of a x-y plane with a mutual distance between said sides (11,12) measured along a z-axis orthogonal to the x-y plane, and a front facing side (14) and a rear facing side (16), and a top (18) and a bottom (20), wherein a. A first sound transducer (22) is arranged inside a first cavity (24) inside said loudspeaker housing (10), where said first sound transducer comprises a membrane, where said first cavity (24) has a narrow first slit (26) in the y-direction provided in the rear facing side (16), where said first slit (26) has a width z1 in the z-direction, and a length y1 in the y-direction where the length y1 in the y-direction is larger than the width z1 in the z-direction;

b. A second sound transducer (30) is arranged inside a second cavity (34) inside said loudspeaker housing (10), separate from said first cavity (24), where said second sound transducer comprises a membrane and where said second cavity (34) is provided with a narrow second slit (36) in the y-direction provided in the front facing side (14), where said second slit (36) has a width z2 in the z-direction, and a length y2 in the y-direction, where the length y2 in the y-direction is larger than the width z2 in the z-direction, where the first sound transducer (22) is tilted such that the cavity (24) between the first sound transducer's membrane and the housing side (12) covering the front of the first sound transducer (22) is wedge-shaped with the thick end of the wedge-shaped cavity adjacent to the slit (26), where the two sides (11,12) are not parallel, and where the distance between the two sides along the front facing side (14) is smaller than the distance between the two sides along the rear facing side (16).

2. Loudspeaker according to claim 1 wherein with respect to the first slit (26) the width z1 is between 10-60% of the largest dimension of the membrane of the first sound transducer (22) and where the length y1 is between 50-300% of the largest dimension of the membrane of the first sound transducer (22).

3. Loudspeaker according to claim 1 where with respect to the second slit (36) the width z2 is between 10-60% of the largest dimension of the membrane of the second sound transducer (30) and where the length y2 is between 50-300% of the largest dimension of the membrane of the second sound transducer (30).

4. Loudspeaker according to claim 1 where a third sound transducer (40) is arranged in the front facing side (14), said third sound transducer (40) arranged in a separate third cavity or in an acoustic volume created behind the membrane of the first sound transducer (22).

5. Loudspeaker according to claim 1 wherein the first sound transducer (22) mainly emits sound along an axis W, where said axis W is at an angle of between 45° and 90° relative to the x-y plane and where said axis W is substantially parallel to the x-z plane.

6. Loudspeaker according to claim 1 wherein the second sound transducer (30) mainly emits sound along an axis K where said axis K is at an angle of between 45° and 90° relative to the x-y plane and where said axis K is substantially parallel to the x-z plane.

7. Loudspeaker according to claim 1 where the second sound transducer (30) is tilted such that any resonance occurring in the second cavity (34) is moved to a frequency as high as possible while leaving space for an optional absorbent material (38) for damping the resonance.

8. Loudspeaker according to claim 1 wherein the distance between the sides (11,12) in the z-direction is between 30% and 150% of the largest dimension of the membrane of the first sound transducer (22), and where the distance between the top (18) and bottom (20) is between 150% and 500% of the largest dimension of the membrane of the first sound transducer (22) and where the distance between the front facing side (14) and the rear facing side (16) is between 100% and 350% of the largest dimension of the membrane of the first sound transducer (22).

9. Loudspeaker according to claim 1 wherein the front facing side (14) and/or the rear facing side (16) are curved or semi-circular when projected onto the x-z plane.

10. Loudspeaker according to claim 1 wherein the first sound transducer (22) is a woofer, the second sound transducer (30) is a midrange sound transducer and the optional third sound transducer (40) is a tweeter, and where the sound transducers are selected to cover a combined frequency range from 40 to 25,000 Hz.

* * * * *